United States Patent [19]

Bryce et al.

[11] 3,978,784

[45] Sept. 7, 1976

[54] CALENDAR CONTROL SYSTEM

[75] Inventors: Rodney Harold Bryce, Lachine; Alfred Edel, Montreal; Adu Randpalu, LaSalle, all of Canada

[73] Assignee: Dominion Engineering Works, Limited, Lachine, Canada

[22] Filed: Nov. 11, 1974

[21] Appl. No.: 522,450

[52] U.S. Cl. ..... 100/170; 92/43; 92/76; 92/140

[51] Int. Cl.[2] ..... B30B 3/04

[58] Field of Search ..... 92/37, 43, 76, 140; 100/168, 170, 171

[56] References Cited

UNITED STATES PATENTS

| | | | |
|---|---|---|---|
| 1,131,704 | 3/1915 | Janney | 92/76 X |
| 2,637,334 | 5/1953 | Starkey | 92/37 X |
| 2,753,882 | 7/1956 | Bottoms | 92/76 X |
| 2,971,457 | 2/1961 | Hold | 100/170 |
| 3,332,260 | 7/1967 | Bisang | 100/170 |
| 3,445,070 | 5/1969 | Verdier | 100/170 |
| 3,515,637 | 6/1970 | Reynolds | 100/168 |
| 3,544,237 | 12/1970 | Walz | 92/37 X |
| 3,643,496 | 2/1972 | Zajic | 92/37 X |
| 3,730,079 | 5/1973 | Stirk | 100/170 |
| 3,731,595 | 5/1973 | Wentworth, Jr. | 92/37 |
| 3,777,656 | 12/1973 | Müller | 100/170 |
| 3,796,149 | 3/1974 | Heissenberger | 100/170 |
| 3,889,466 | 6/1975 | Castela | 92/140 X |

FOREIGN PATENTS OR APPLICATIONS

| | | |
|---|---|---|
| 576,239 | 5/1959 | Canada |
| 724,911 | 1/1966 | Canada |
| 850,362 | 9/1970 | Canada |

*Primary Examiner*—Martin P. Schwadron
*Assistant Examiner*—Abraham Hershkovitz
*Attorney, Agent, or Firm*—Raymond A. Eckersley

[57] ABSTRACT

A calendar stack is provided with pneumatic actuators of the expansible bag or bellows type wherein a selected roll has the end bearings thereof carried by a pair of pivoted control arms, the position of a respective control arm being selectively controlled, for upward loading or for downward loading of the stack by a single primary actuator. The selected direction of force application by the primary actuator is determined by a force transmission linkage shiftable by a secondary actuator between a first and a second position, for roll upward loading or roll downward loading.

12 Claims, 3 Drawing Figures

CALENDAR CONTROL SYSTEM

This invention is directed to a power system incorporating a primary actuator operable in a first mode having a secondary actuator to change the condition of the primary actuator, for operation in a second mode.

In the operation of machine positioning devices widespread use is made of hydraulic actuators of the piston and cylinder type, which are capable of operation at high pressure and can generate large forces with relatively small mechanisms.

In the paper making industry the use of such hydraulic actuators suffers from some quite serious drawbacks.

In particular, the utilisation of high pressure hydraulic actuators involves the provision of a high pressure oil source and piping which, together with the actuator itself, are all susceptible to leakage, with the likelihood of product contamination therefrom. Furthermore, paper handling mechanisms such as calenders and presses are subject to the passage of lumps, which produce shock loading to the associated rolls, and to the hydraulic system by which the rolls are controlled. System resilience can be achieved by the provision of pneumatic accumulators, which however add to the complexity and cost of the hydraulic system.

While the use of pneumatic air bag actuators conveys many advantages over hydraulics on the basis of cost, reliability, resilience to shock reverse loading, low friction, and an absence of oil leakage contamination, they suffer from the particular disadvantage of being single acting.

The present invention provides an air bag primary actuator system including a load application linkage and a secondary actuator connected in controlling relation therewith for positioning the primary actuator in a desired loading mode. This makes possible the operation of the primary actuator substantially in a double-acting mode.

Owing to the low rated duty of the secondary or positioning actuator, a hydraulic actuator may be utilised with little stress and small chance of seal leakage, or an air driven double acting piston and cylinder actuator may be employed as the secondary or positioning actuator.

The present invention has particular utility when used to load or to unload a calender stack. In an arrangement of a calender stack in accordance with U.S. Pat. No. 3,611,917 Vadas et al issued Oct. 12, 1971, there is provided a swimming roll, the deflection of which under load may be controlled, and which may be used in a stack-unloading sense or in a stack loading sense.

This calender arrangement particularly lends itself to use with the present invention, owing to the space requirements, and the capability of operating the swimming roll, located in an intermediate position in the stack, either in an unloading sense, to unload all or part of the calender nips located therebeneath, or in a loading sense, to increase the load values at the underlying nips.

An object of the present invention is the provision of an actuating apparatus, having a useful input in a first mode and in a second mode, comprising primary actuator means, first actuator output means connected thereto for connection with a load when in the first output mode, second actuator output means connected with the primary actuator for connection with the load when in the second output mode and secondary actuator means connected in controlling relation with the output means to selectively connect the primary actuator to a load in the first mode or in the second mode.

Thus there is provided an actuating apparatus selectively operable to provide a force output in at least two optional directions, comprising a primary actuator, having a uni-directional output, force modifying first linkage means operable in a first mode for connecting the primary actuator with a load output in a first one of the optional directions, second force modifying linkage means connecting the primary actuator with the load output in a second one of the optional directions, and a secondary actuator connected in positioning relation with the first and second linkage means and controllable to provide selective positioning movement thereto for connecting the primary actuator selectively in the first or the second mode.

Certain embodiments of the invention are described, reference being made to the accompanying drawings wherein.

Figure 1:
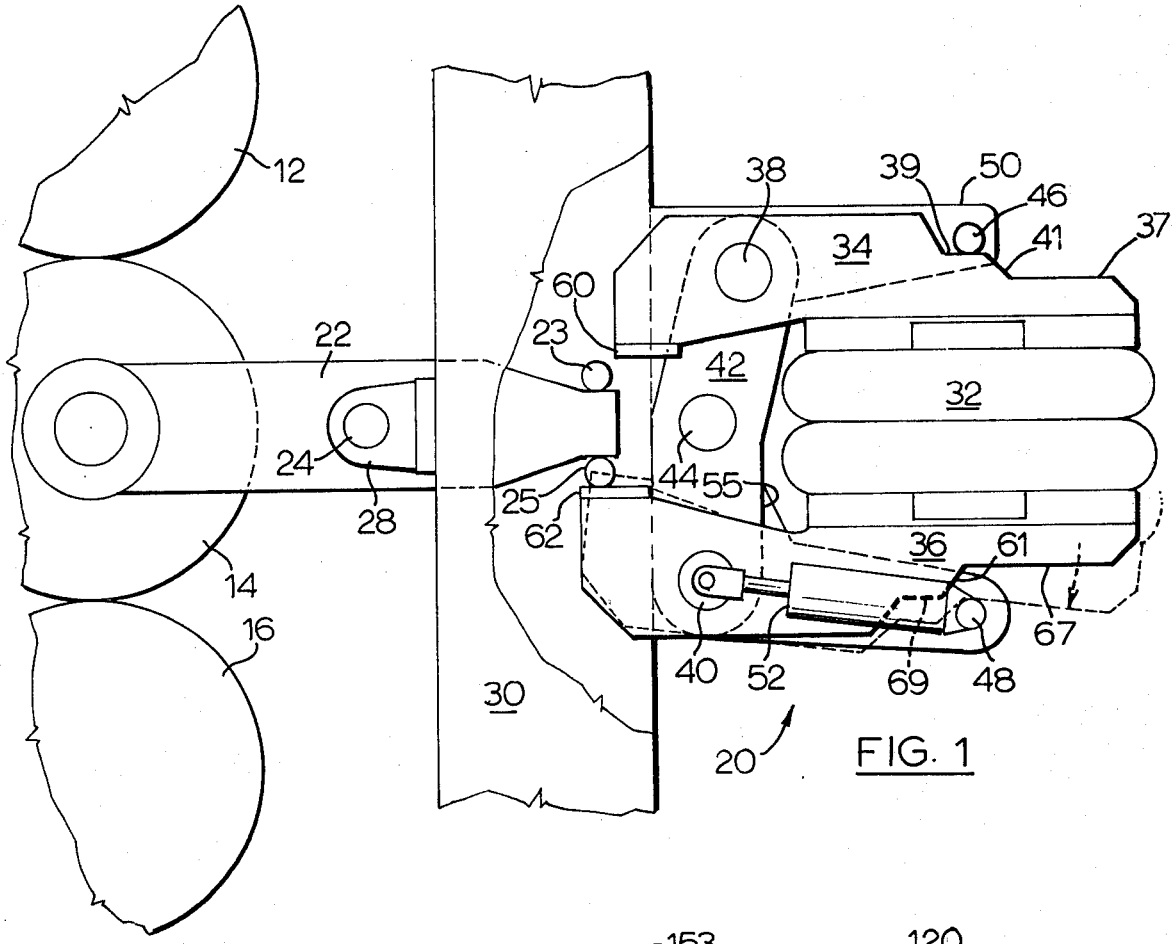
FIG. 1 is a side elevational view of a portion of a calender stack incorporating a first embodiment of the present invention.

Referring to FIG. 1, the assembly 10 comprises an intermediate roll 14 located between a lower roll 16 and an upper roll 12.

A load control arrangement 20 applies force to each of the arms 22 of a pair of roll suspension arms, each of which arms 22 is pivoted at 24 from a bracket 28 carried on the calender frame 30. The arm 22 is provided with an upper load pad 23 and lower load pad 25. A single large load transfer roller 123 may be substituted therefor, as in FIG. 2, being mounted on a corresponding arm.

The arrangement 20 of FIG. 1 has as primary actuator an air bag 32 expansibly mounted between a top pivotal link 34 and a bottom pivotal link 36. The links 34, 36 are respectively pivoted on pivot pins 38, 40 which pivot pins 38, 40 are carried on crank lever 42. The crank lever 42 in turn is pivotally mounted on mounting pin 44 which is secured to the frame 30 by way of a suitable bracket (not shown).

A pair of fixed abutment pins 46, 48 are shown, the mounting of the top abutment pin 46 on a bracket 50 extending from the frame 30 being illustrated.

The lower abutment pin 48 is similarly mounted from the calender frame 30.

The fixed abutment pins 46, 48 serve dual functions, namely to provide an anchoring or reactive force to the primary actuator and to serve as a motion limit stop for the primary actuator.

A secondary actuator 52, being a double acting pneumatic piston and cylinder actuator in the illustrated embodiment and shown expanded, is mounted between pivot pin 40 and abutment pin 48.

In operation, with the secondary actuator 52 in the expanded condition illustrated, the crank lever is in the position shown having the lower leg 55 of the crank lever secured in abutting relation against the side of calender frame 30, with the pivot pin 40 positioned substantially vertically below the crank lever mounting pin 44.

In this condition, a loading pad 62 of the bottom pivotal link 36 is positioned in load transfer relation beneath the load pad 25 of the arm 22.

Due to support provided to the intermediate roll 14 by the adjacent lower roll 16 the arm 22 is stabilized, and load pad 25 supports the surface portion 67 of the bottom pivotal link 36 in spaced relation from the lower abutment pin 48.

The top pivotal link 34, with the secondary actuator 52 in this expanded condition as illustrated has a stepped surface 39 positioned in abutting relation against the top abutment pin 46, to receive reactions force therefrom upon loading of the primary actuator 32.

In this condition, the admission of pressurised air to the primary actuator air bag 32 to cause expansion of the bag produces downward motion of the link 36 in pivotting relation about its pivot pin 40 to produce an upward force by the loading pad 62 thrusting against the arm load pad 25. The link 36, when displaced to its fullest extent, can swing downwardly into abutting relation against the lower abutment pin 48, to the link position shown in phantom which constitutes the limit of the working stroke.

Thus, in the illustrated condition a loading force is applied downwardly by the arm 22, to load the roll 14 downwardly against the lower roll 16, thus loading all of the rolls of the calender stack located beneath the roll 14.

Operation of the apparatus 20 in a load relieving mode is initiated by depressurisation of the primary actuator bag 32. Actuation of the secondary actuator 52 in a contracting sense, draws the pivot pin 40 in a right-ward direction towards the abutment pin 48. This produces anti-clockwise rotation of the crank lever 42 about its supporting pivot pin 44, to move the upper leg of lever 42 into abutting relation with the calender frame 30, thus positioning the pivot pin 38 substantially vertically aligned above the mounting pin 44. This anti-clockwise displacement of the link 34 brings the loading pad portion 60 thereof into load transfer coincidence with the top load pad 23 of the arm 22, while displacing the loading pad portion 62 of the bottom link 36 clear of the bottom load pad 25 of the arm 22. At the same time the surface portion 69 of the lower link 36 is moved rightwardly into abutting supported relation with the lower abutment pin 48 to receive requisite reaction force support therefrom, while the surface portion 37 of the upper link 34 is located in spaced relation from the upper abutment pin 46.

With the loading arrangement of the apparatus 20 thus conditioned by contraction of the secondary actuator 52, upon pressurization of the primary air bag 32 upward pivotal displacement of the link 34 about its pivot pin 38 is produced. This in turn produces downwardly displacement of the loading pad 60 and the associated load pad 23 of the arm 22. The roll 14 is thus urged upwardly to the extent permitted when the surface 37 of link 34 contacts the upper abutment pin 46.

In the subject construction, owing to the provision of the intermediate inclined cam surfaces 41, 61 on the respective upper link 34 and lower link 36, the transfer or condition change of the apparatus is effected smoothly.

In addition to the provision of a simple, low cost loading-unloading device, requiring minimal maintenance, and no high pressure hydraulic circuits with their attendant tendency to pollute the environment and the product, the subject invention also provides inherent safety and simple operation, while the calender stack benefits during its operation by the provision of a pneumatic spring effect to permit the ready passage of lumps therethrough.

Due to the geometry of the linkage, particularly the links 34, 36 and the crank lever 42, there is little or no stress on the secondary actuator 52 during operation of the main actuator 32, and the direction of load forces on the linkage tends to hold the crank lever 42 in pressing relation against the frame 30. Thus a low pressure secondary actuator of relatively low load capacity may be utilised. The use of an air cylinder is contemplated.

Figure 2:
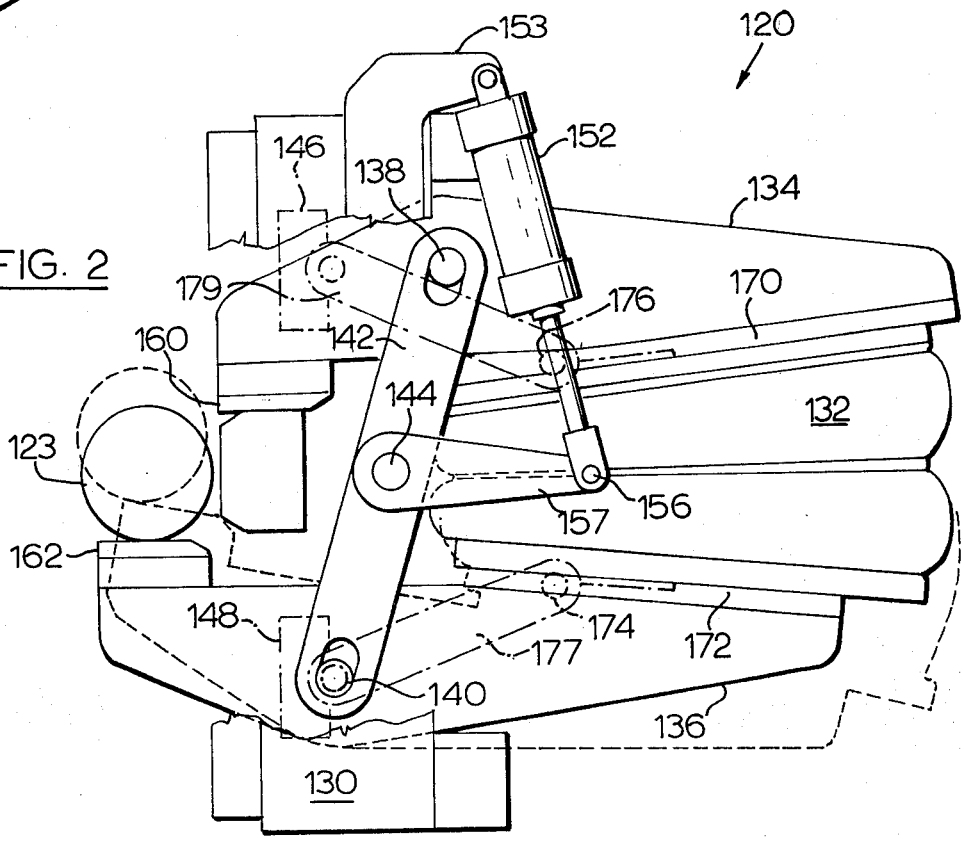
FIG. 2 is a like view of a portion of a second embodiment.

Referring to the FIG. 2 embodiment, the arrangement 120 provides force in a selected up or down direction against a load roller 123 carried by a respective roll suspension arm (not shown) similar to the arm 22 arrangement of FIG. 1.

While the FIG. 2 embodiment is similar in function to the FIG. 1 embodiment there are certain structural differences. Thus the primary actuator air bag 132 is provided with stabilizing plates 170, 172 mounted by pivots 174, 176 on trailing links 177, 179 (shown in phantom). These plates 170, 172 and links 177, 179 preclude skewing of the air bag 132 when the secondary actuator 152 repositions the respective top link 134 and bottom link 136, in changing the apparatus from one loading mode to the other. Slots for pins 138, 140 permit lost motion when repositioning from an up-loading to a down-loading condition.

The secondary actuator 152 is supported from a bracket 153, which is attached to the calender frame 130.

The actuator 152 connects at 156 with a lever arm 157, which controls the crank lever 142, so as to transversely position the links 134, 136.

The crank lever 142 pivots about its mounting pin 144, to bring either the pivot pin 140 of the bottom link 136 into abutting relation against restraining plate 148, as illustrated, or to bring the pivot pin 138 of the top link 134 into abutting relation against restraining plate 146.

In the illustrated position of the mechanism, with the bottom link 136 moved leftwardly into an operative or active position, having its loading pad 162 engaging the load roller 123, the load pad 160 of the top link 134 is positioned in abutting restrained relation against abutment pad 180, in a deactivated or reaction position. In this position the top link 134 is immobilised against counter-clockwise rotation so as to provide restraint to the air bag 132 against upward expansion. Thus the air bag 132 may only expand downwards, thereby acting on the bottom link 136, to apply upwardly directed force against load roller 123.

With air bag 132 in an unloaded, non-pressurised condition the secondary actuator 152 may be actuated in the reverse sense to that shown, so as to move the connection 156 upwardly. This repositions the mechanism, moving the top loading pad 160 leftwardly into loading relation with the load roller 123 and moving the bottom loading pad 162 rightwardly into vertically immobilised reaction contact with the abutment pad 180.

In this condition the air bag 132 is free only to expand upwardly, thereby applying a counterclockwise turning movement to the top link 134, to load the load roller 123 downwardly.

Figure 3:
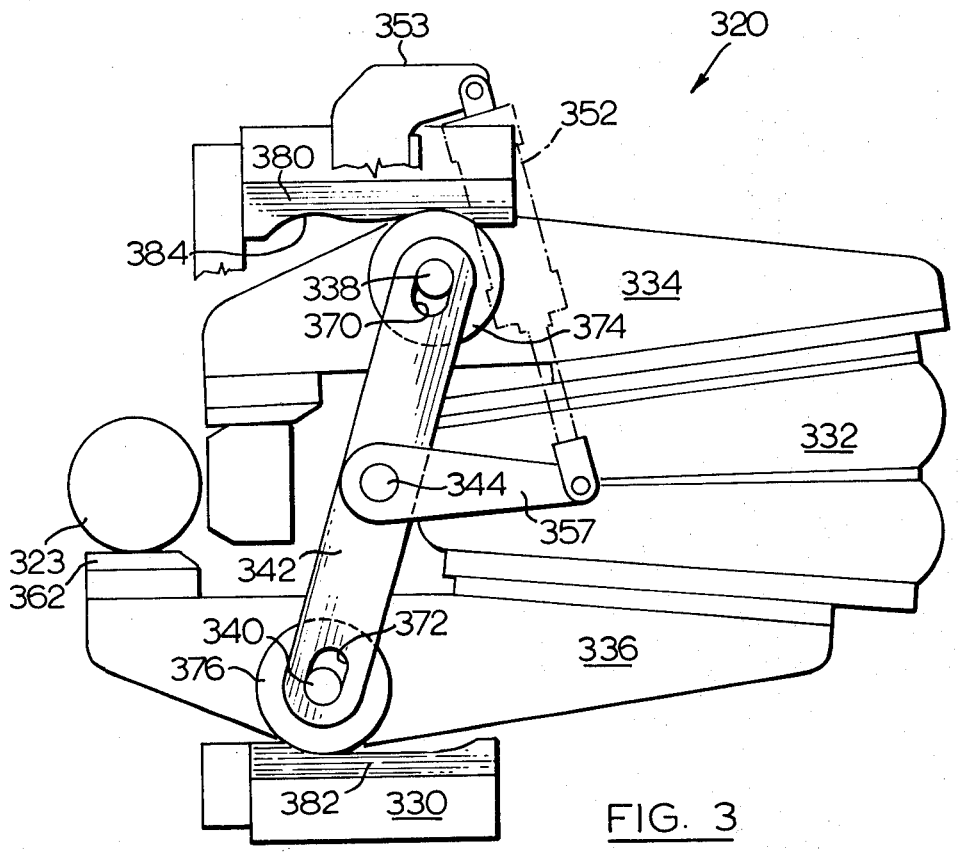
FIG. 3 is a like view of a third embodiment.

Referring to the FIG. 3 embodiment in the arrangement 320 the air bag 332 is mounted between top link 334 and bottom link 336. Crank lever 342 is provided with slotted recesses 370, 372 in which are carried respectively the axles 338, 340 of a pair of top rollers 374 and bottom rollers 376. The roller pairs, of which only one roller of each pair is shown, are mounted astride the respective links 334, 336, the axles 338, 340 being securely journalled in the respective links 334, 336. A top load bracket 380 and bottom load bracket 382 secured to the calender frame 330 provide reaction forces to the rollers 374, 376 against the loads applied to the links 334, 336 when the air bag is pressurised. The top load bracket 380 is provided with cam surfaces 384 by means of which the roller 374 is localised in one or other of its operational positions, in accordance with the expanded or contracted condition of the secondary actuator 352.

In operation, as described with reference to FIG. 2, the FIG. 3 apparatus is illustrated in a roll loading condition, wherein the load roller 323 has upward force applied thereagainst by load pad 362, when the primary actuator air bag 332 is pressurised. In this condition the primary reaction loads for locating the links 334, 336 are transmitted from the top bracket 380 and bottom bracket 382 to the links 334, 336 respectively, by way of rolls 374, 376 and their respective axles 338, 340. In this fashion undue loading of the crank lever 242 is avoided.

Upon depressurisation of the primary air bag 332 the link 334 subsides downwardly, the axle 338 travelling in the slot 370 to a lower position, so that the rolls 374 can clear the lobe of cam surface 384. In this condition the secondary actuator 352 is free to reposition with minimal force the crank lever 342 anticlockwise, the lower rolls 376 being displaced laterally in the planar recess of bracket 382.

It will be evident that a single acting hydraulic actuator and a return spring system, relying upon a hydraulic lock-up may be substituted for the secondary actuator. However, certain attractive features of the present invention are then lost.

What I claim as new and desire to secure by Letters Patent of the United States is:

1. Actuating apparatus selectively operable to provide force output in at least two optional directions, comprising:

a primary actuator having a uni-directional output; first linkage means operable in a first mode for connecting said primary actuator with a force output member for working movement in one said optional direction; second linkage means connecting said actuator with a force output member and operable in a second mode for working movement in another said optional direction; and a secondary actuator connected in positioning relation with said first and said second linkage means to provide selective positioning movement thereto for selectively connecting said primary actuator for actuating a selected said linkage means and said force output member in a respective direction, and to position the other said linkage means in reaction providing relation with said primary actuator.

2. Actuating apparatus as claimed in claim 1 wherein said primary actuator includes expansible gas chamber means expansible when operating in a working mode, said first linkage means being connected to one portion thereof for useful output in said first direction, said second linkage means being connected to another portion of said expansible means to transmit a useful output therefrom in said another direction, and abutment means associated with each said linkage means to provide reaction force thereto when the respective other linkage means is connected in working mode with a respective said force output member, whereby said expansible means is restrained at a selected side thereof to provide said uni-directional output in said selected direction.

3. Apparatus as claimed in claim 2, wherein said primary actuator is an expansible bellows, a first said abutment means securing one said linkage in fixed relation, to stay one end of said bellows, whereby expansion of the bellows actuates the other said linkage.

4. Apparatus as claimed in claim 3 wherein said secondary actuator is a two stroke device to provide positive displacement of each said linkage means to a respective active and reactive position.

5. Apparatus as claimed in claim 4 wherein said force output members are connected in controlling relation with a roll of a calendar stack, to provide selective loading and unloading force to the respective calendar roll, by way of a pair of pivoted arms carrying said roll rotatably mounted at the ends thereof between said arms, whereby actuation of said roll in a loading and an unloading sense is effected using a single pair of said single acting gas powered bellows actuators.

6. Actuating apparatus selectively operable in two modes to provide force output in a selected one of two optional directions, comprising:

a primary actuator having an expansible bag to receive a fluid in bag expanding relation; force output means to utilise force developed in the expansion of said bag; first force transfer linkage means to apply a reactive load force to a first side of said bag, and second force transfer linkage means to connect a second side of said bag in force transfer relation to said force output means; changeover linkage means interconnecting said first and said second transfer linkage means to exchange the respective functions thereof, and secondary actuator means connected to said changeover linkage means in controlling relation therewith to position the apparatus in a selected said mode.

7. The apparatus as claimed in claim 6 wherein said first and said second force transfer linkage means each include a link pivoted intermediate the ends thereof moveable to a reactive-force developing position having one end thereof in opposed relation with a fixed abutment and the other end in force transfer relation with said bag; said one end being moveable into contacting relation with said force output means on changeover from one said mode to the other said mode.

8. The apparatus as claimed in claim 6 including stabilizing plate means connected with said force transfer linkage means to preclude skewing of the bag on operation of said changeover linkage means.

9. The apparatus as claimed in claim 8, said stabilizing plate means comprising a top and a bottom plate each having a portion thereof interposed between said bag and a respective said force transfer linkage means, and a link securing said plate portion in spaced relation from a fixed datum.

10. The apparatus as claimed in claim 7, said first and said second link each having a roller attached in pivotal supporting relation thereto and connected to a respective said changeover linkage means by a lost motion connection, whereby, on depressurisation of said expansible bag primary actuator said secondary actuator can reposition said first and second links to bring each said roller into repositioned reactive relation with said fixed abutment.

11. A rolling device having at least two rolls mounted for rotation to form a pressure nip between the rolls, for the passage of a web therethrough, when in use, in combination with load modifying means comrising a single acting primary actuator, first linkage means connectable between said primary actuator and at least one said roll in a nip loading sense, second linkage means connectable between said primary actuator and at least one said roll in a nip unloading sense, and secondary actuator means connected to said linkage means to selectively connect said first and said second linkage means between said primary actuator and said rolls whereby said pressure nip may be selectively loaded and unloaded.

12. The combination as claimed in claim 11 wherein said two rolls comprise a portion of a calender stack.

* * * * *